US009856736B2

(12) United States Patent
Stiehler

(10) Patent No.: US 9,856,736 B2
(45) Date of Patent: Jan. 2, 2018

(54) FISH MOUTH SEAL CARRIER

(71) Applicant: MTU AERO ENGINES AG, Munich (DE)

(72) Inventor: Frank Stiehler, Bad Liebenwerda (DE)

(73) Assignee: MTU Aero Engines AG, Munich (DE)

( * ) Notice: Subject to any disclaimer, the term of this patent is extended or adjusted under 35 U.S.C. 154(b) by 1113 days.

(21) Appl. No.: 14/056,876

(22) Filed: Oct. 17, 2013

(65) Prior Publication Data

US 2014/0105725 A1 Apr. 17, 2014

(30) Foreign Application Priority Data

Oct. 17, 2012 (EP) ..... 12188822

(51) Int. Cl.

| | |
|---|---|
| ***F01D 11/00*** | (2006.01) |
| ***B21J 5/00*** | (2006.01) |
| ***F01D 11/02*** | (2006.01) |
| ***F01D 5/08*** | (2006.01) |

(52) U.S. Cl.

CPC ..... *F01D 5/08* (2013.01); *F01D 11/001* (2013.01); *F01D 11/02* (2013.01); *Y10T 29/49321* (2015.01)

(58) Field of Classification Search

CPC .. Y01T 29/49321; F01D 11/001; F01D 11/02; F01D 5/08; B21J 5/00; Y10T 29/49297; Y10T 29/49893; Y10T 29/49968; Y10T 29/49988

See application file for complete search history.

(56) References Cited

U.S. PATENT DOCUMENTS

| | | | | |
|---|---|---|---|---|
| 3,603,599 | A * | 9/1971 | Laird | F01D 11/127 277/414 |
| 5,215,435 | A | 6/1993 | Webb et al. | |
| 2004/0123445 | A1* | 7/2004 | Esaki | B21C 37/045 29/463 |
| 2008/0258404 | A1* | 10/2008 | Pillhoefer | C23C 10/02 277/415 |
| 2013/0045089 | A1* | 2/2013 | Bridges | F01D 11/005 415/173.7 |

FOREIGN PATENT DOCUMENTS

| | | | | |
|---|---|---|---|---|
| DE | 102010055435 A1 * | 6/2012 | | F01D 9/00 |

OTHER PUBLICATIONS

Machine translation of DE102010055435A1.*

* cited by examiner

*Primary Examiner* — Dwayne J White
*Assistant Examiner* — Justin Pruitt
(74) *Attorney, Agent, or Firm* — Munck Wilson Mandala LLP

(57) ABSTRACT

A fish mouth seal carrier for a guide vane arrangement of a gas turbine comprises a first half-shell element and a second half-shell element bonded to it, which together form a box profile with two axial arms and two radial arms. A sealing element is arranged on one of the axial arms of the box profile. At least one of the two half-shell elements has an integrally formed axial flange for forming, with a guide vane platform, a fish mouth seal accommodating an axial flange of an adjoining moving blade radially between the guide vane platform and the axial flange of the seal carrier.

17 Claims, 2 Drawing Sheets

FISH MOUTH SEAL CARRIER

CROSS-REFERENCE TO RELATED APPLICATIONS

This application claims priority to and/or the benefit of European Patent Application No. 12188822.6-1607, filed Oct. 17, 2012, entitled FISCHMAUL-DICHTUNG-STRÄGER, the specification of which is incorporated by reference herein in its entirety.

TECHNICAL FIELD

The present invention relates to a seal carrier for mounting on a guide vane of a gas turbine. In particular, it relates to a seal carrier forming a fish mouth seal (i.e., a fish mouth seal carrier), a guide vane arrangement with such a fish mouth seal carrier, or a gas turbine with such a fish mouth seal carrier, as well as methods for production of same.

BACKGROUND

A gas turbine is known from U.S. Pat. No. 5,215,435 A, with a guide vane arrangement with a platform on which is attached a fish mouth seal carrier with a honeycomb seal. The fish mouth seal carrier is composed of a total of five sheet metal parts: an S-shaped sheet metal part for forming a fish mouth seal, an L-shaped sheet metal part for forming an opposing fish mouth seal, a U-shaped sheet metal part between whose radial arms is arranged a radial flange of the platform and a screw head, a C-shaped sheet metal part, in which a washer is housed, is penetrated by the screw, and lastly a G-shaped sheet metal part that carries the S-shaped sheet metal part, wherein the honeycomb seal is attached to the L- and G-shaped sheet metal parts.

SUMMARY AND DESCRIPTION

An object of an embodiment of the present invention is to improve the production and/or operation of a gas turbine.

This object is solved by a fish mouth seal carrier with the features described and claimed herein. Additional embodiments are described including a guide vane arrangement, a gas turbine with such a fish mouth seal carrier and a method for its production. Advantageous enhancements are the subject matter of the dependent claims.

According to one aspect of this invention, a fish mouth seal carrier for a guide vane arrangement of a gas turbine has a first half-shell element and a second half-shell element bonded, particularly welded, to it, which together form a box profile with two axial arms and two radial arms. A sealing element, which, in an embodiment, has a honeycomb seal, or in particular can be one, is arranged on the exterior side of one of these radially inner, when in the installation position, axial arms of the box profile.

By means of this box construction, in an embodiment, particularly compared to the open profile of U.S. Pat. No. 5,215,435 A, the operating behavior, particularly a rigidity, of the fish mouth seal carrier or position of its sealing element can be improved. A box profile according to the present invention refers in particular to a profile that has two, particularly at least essentially parallel axial arms and two particularly at least essentially parallel radial arms, and particularly consists of these, which transition, in an enhancement, into preferably at least essentially right-angled corners. The corners may have a radius or a bevel.

The first and/or second half-shell element each has an axial flange for forming a fish mouth seal that is designed in an integral or one-piece manner with the half-shell element, in particular primary-shaped or formed.

By means of this integral construction, an embodiment enables one to improve, particularly when compared to the many sheet metal parts of U.S. Pat. No. 5,215,435 A, the production and/or operating behavior of the fish mouth seal carrier.

The axial flange functions in an embodiment as a so-called deflector of the fish mouth seal. Radially across from it, in an embodiment, lies a radial inner platform of a guide vane arrangement with one or more guide vanes on which is suspended, in an embodiment, the fish mouth seal carrier by means of a spoke-centering. Radially between the platform and the axial flange is an axial flange of an adjoining blade arrangement with one or more blades. As explained above, a fish mouth seal can be designed upstream and/or downstream of the guide vane arrangement or the first and/or second half-shell element of the fish mouth seal carrier can have a corresponding axial flange designed as a deflector. The axial flange of the first and/or second half-shell element extends, in an embodiment, at least essentially in an axial direction. In doing so, it may have radial passages or stages.

In an embodiment, the first half-shell element has a U-profile for forming the box profile and a radial flange integrally designed with it. In an embodiment, on the radial flange, one can connect the axial flange on the side radially opposite the U-profile to form a fish mouth seal.

The second half-shell element can have a radial flange on which, in an embodiment, the axial flange can be connected to form a fish mouth seal. On the side radially opposite to the axial flange, the radial flange together with the U-profile of the first half-shell element can form the box profile, i.e., seal the U-profile in a lid-type manner and essentially form a radial arm of the U-profile. In an alternative embodiment, a U-shaped profile also connects to the radial flange on the side radially opposite to the axial flange to form the box profile so that both half-shell elements each form a radial arm and each form a part of both axial arms of the box profile.

In an embodiment, a slide body for suspending the fish mouth seal carrier on the guide vane arrangement is mounted on both sides between the radial flange of the first half-shell element and the radial flange of the second half-shell element. In particular, the fish mouth seal carrier may have a bolt for this purpose, that penetrates through-holes in the radial flanges and the slide body arranged between these to thereby fix it. The bolt may in particular be removably or non-removably attached, in particular screwed or riveted, to the radial flange. In an embodiment, the slide body may be accommodated in a through-hole, particularly an elongated hole, of the guide vane arrangement so that the guide vane arrangement is suspended. The slide body may in particular space apart and/or support the two radial flanges, and thus improve the rigidity of the box profile.

In addition or as an alternative, an additional plate may be fixed to the radial flange of the first or second half-shell element. It may be supported axially on the guide vane arrangement and thus axially secure the fish mouth seal carrier. In an embodiment, the additional plate may be arranged between the radial flange of the first half-shell element and the radial flange of the second half-shell element, particularly between the slide body and a radial flange. In an embodiment, the additional plate can be fixed in a frictionally engaged manner to the radial flange, particularly be clamped between it and the slide body, particularly by a bolt that connects the two radial flanges and/or seats the slide body. In an embodiment, the additional plate that is fixed in a frictionally engaged manner establishes joint-type friction that can advantageously dampen vibrations. Similarly, the additional plate can be fixed to the radial flange in a firmly bonded manner, in particular be welded to it.

In an embodiment, the sealing element extends at least essentially axially from the one radial arm to the other of the box profile. In this way, a wide support surface can be provided and the box profile can be optimally used.

In an embodiment, the sealing element has a honeycomb seal and in an enhancement a carrier, particularly a carrier plate, either one of which is arranged on the exterior side of the axial arm, particularly in a bonded manner, connected to it, particularly soldered, welded, or adhered, and on its side facing away from the axial arm, there is attached the honeycomb seal in a firmly bonded manner, particularly soldered, welded or adhered. Similarly, the carrier can be integrated into the honeycomb seal or arranged directly on the exterior side of the axial arm, and particularly connected to it in a bonded manner, particularly soldered, welded, or adhered.

In an enhancement, the honeycomb seal can extend at least essentially axially from the one radial arm to the other of the box profile and the carrier in contrast projects axially over one or both radial arms. This can protect the honeycomb seal particularly when there is axial rubbing. Similarly, the honeycomb seal can extend axially from the one radial arm to the other and beyond one or both radial arms or it can itself project over one or both radial arms, particularly to axially expand the sealing surface.

In an embodiment, on one or both radial arms of the box profile at least on the side facing or facing away from the box profile, there is attached a reinforcing element, particularly a reinforcing plate, particularly in a bonded manner, preferably by welding, soldering, or adhering. In addition or alternatively, one or both radial arms may have an integral thickening of the wall-thicknesses. By means of this separately applied and/or integrally designed reinforcement of the radial arm or arms, one can increase in an embodiment the robustness against axial rubbing.

In an enhancement, the reinforcing element is designed as a radial ring, whose wall thickness in a radial direction is at least double its wall thickness in an axial direction. In this way, the reinforcing element can, in an embodiment with little weight and required space, provide an enlarged rubbing surface in a radial direction, particularly to compensate for radial play and/or tolerances. Similarly, the reinforcing element can be designed as an axial ring, whose wall thickness in an axial direction is at least double its wall thickness in a radial direction. In this way and in an embodiment, the reinforcing element can with low weight and required space provide a contact surface enlarged in an axial direction for a sealing element projecting axially beyond the radial arm. Correspondingly, in one embodiment, the sealing element is also arranged on the reinforcing element, particularly an axial ring, and particularly connected to it in a bonded manner, particularly soldered, welded, or adhered.

In an enhancement, the reinforcing element, particularly the axial ring, has a half-shell element-facing contour, that is at least essentially complementary to a transition, particularly a radius or a bevel, between the seal-facing axial arm and the radial arm of the half-shell element on which the reinforcing element is arranged. In this way, the transition can be accommodated in the reinforcing element and thus, in an embodiment, an empty space and/or the forming of a hard phase can be reduced, particularly avoided. To produce a fish mouth seal carrier according to one aspect of the present invention, one or both half-shell elements are shaped, particularly in a casting-engineered manner. In one design, one or both half-shell elements are designed as sheet metal constructions. In particular, they may have a wall thickness that is 15 mm maximum, particularly 3 mm maximum, preferably 2 mm. Due to the box construction method, a high rigidity in an embodiment can be achieved despite the small wall thickness and correspondingly low weight.

The two half-shell elements are bonded to each other. They may be welded to each other in particular, preferably without additives, particularly by laser or friction welding. In this way, a straightforward joint connection by means of a reliable process can be achieved. Similarly, they can be adhered or soldered to each other.

In an embodiment, the two half-shell elements are contact-joined to each other, particularly with front faces of one axial arm each of a U-profile of the half-shell elements. In this way, the weight can be reduced and/or the welding can be simplified. Similarly, the half-shell elements can be connected to each other surface-wise, particularly by welding the superimposed axial arms of both half-shell elements.

Before or after bonding, the sealing element is arranged on an axial arm of the box profile. In particular, it may be joined integrally to them. In an enhancement, the sealing element may be designed as axially divided, whereby one part, particularly before the bonding of the two half-shell elements to each other, is joined to the first half-shell element and the other part is joined to the second half-shell element. Similarly, the sealing element can also be joined after the bonding of the two half-shell elements to each other with the first and/or second half-shell element. In an embodiment, the sealing element, particularly a honeycomb seal or a carrier, preferably one-piece, connected to it covers a interface or butt joint of the bonded joint connection of the two half-shell elements and thus ensures the joint connection. The sealing element may in particular be bonded to one or both half-shell elements, particularly welded, adhered, or soldered.

Before or after the bonding of the two half-shell elements to each other and/or with the sealing element, a reinforcing element can be arranged on one or both half-shell elements and/or the sealing element, and thus be bonded. In an enhancement, the reinforcing element is initially designed to be ring-shaped, particularly primary-shaped or formed, or joined out of two or more ring segments, particularly in a bonded manner, preferably welded. Subsequently, the ring-shaped reinforcement element is connected to a half-shell element, particularly in a bonded manner, preferably by spot-welding, soldering, or adhering, before or after the latter is connected to the other half-shell element. In this way, the half-shell can be fixed. Then, in an enhancement, the sealing element can be joined, preferably in a bonded manner, to the half-shell element or elements, preferably by welding, soldering, or adhering.

BRIEF DESCRIPTION OF THE DRAWINGS

Additional advantages and features are provided in the dependent claims and the embodiment. To this end are shown the following, in a partially schematized manner:

DETAILED DESCRIPTION

Figure 1:
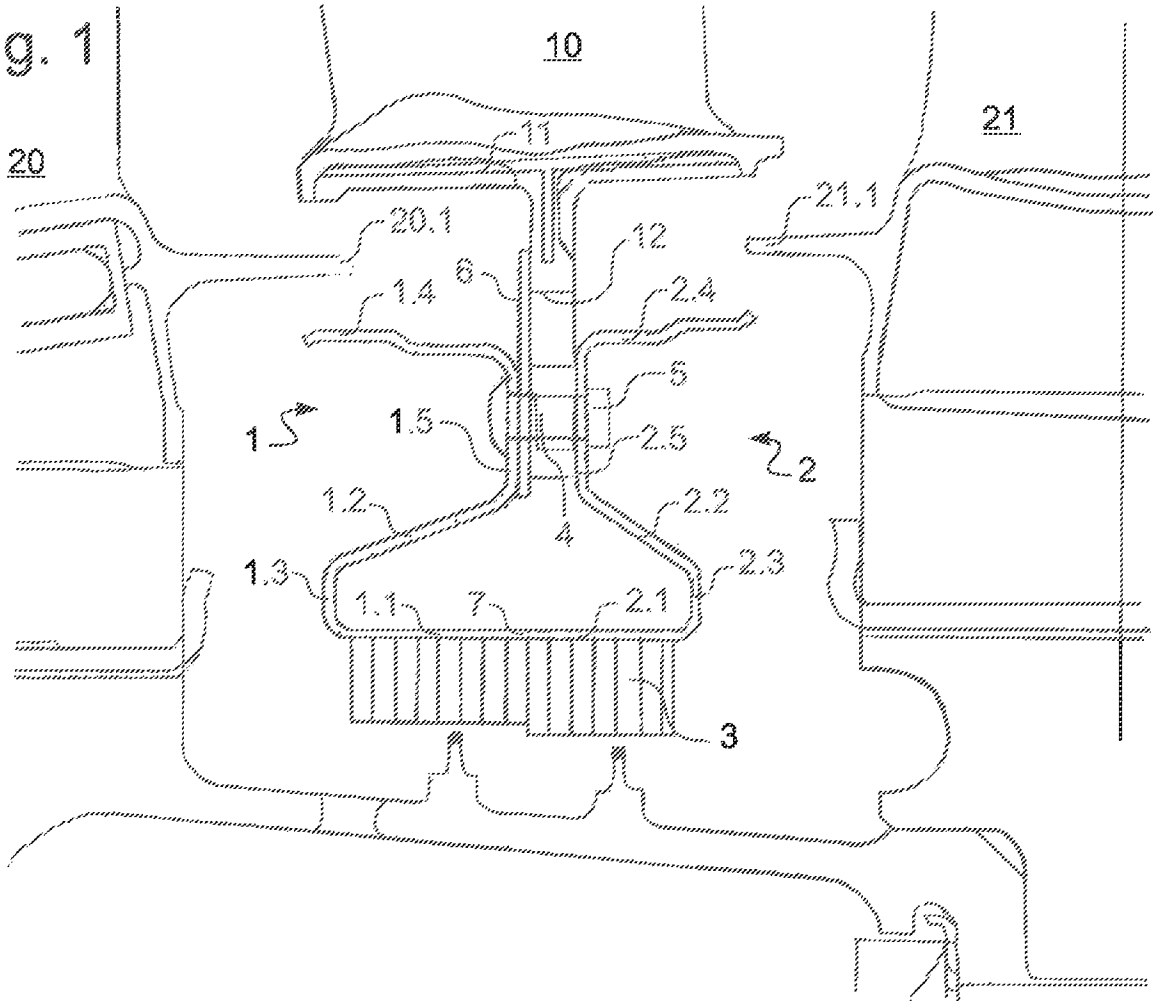
FIG. 1: a fish mouth seal carrier of a guide vane arrangement of a gas turbine according to an embodiment of the present invention in an axial cross-section.

FIG. 1 depicts in an axial cross-section a section of a gas turbine with a guide vane arrangement with multiple guide vanes 10, on whose radial inner (below in FIG. 1) platform 11 a fish mouth seal carrier is suspended.

The fish mouth seal carrier has a first half-shell element 1 and a second half-shell element 2 welded to it, which together form a box profile with two essentially parallel axial arms (1.1+2.1), (1.2+2.2) and two essentially parallel radial arms 1.3, 2.3 that transition into each other in rounded corners. A sealing element in the form of a stepped honeycomb seal 3 is arranged on an exterior side of the radial inner axial arm (1.1+2.1).

The first and second half-shell element each have an axial flange 1.4 and 2.4 respectively for forming a fish mouth seal that is designed in an integral or one-piece manner with the half-shell element and functions as a deflector for the fish mouth seal. Radially across from it lies the radial inner platform 11 of the guide vane arrangement. Radially between platform 11 and axial flange 1.4 and 2.4 respectively is in each case an axial flange 20.1 and 21.1 respectively of an adjoining blade arrangement with blades 20 and 21 respectively. Axial flanges 1.4, 2.4 of the first and second half-shell element extend essentially in an axial direction, wherein they have radial passages or stages.

The first half-shell element has a U-profile 1.1, 1.2, 1.3 for forming the box profile and a radial flange 1.5 integrally designed with it. On the radial flange is connected axial flange 1.4 on the side radially opposite the U-profile (top in FIG. 1) to form the fish mouth seal. The second half-shell element also has a radial flange 2.5 that is essentially parallel to radial flange 1.5 of the first half-shell element and that connects to axial flange 2.4. Also in regard to the second half-shell element, a U-profile 2.1, 2.2, 2.3 connects to radial flange 2.5 on the side radially opposite axial flange 2.4 for forming the box profile, so that both half-shell elements each form a radial arm 1.3 and 2.3 respectively and each form a section 1.1 and 2.1 respectively of an axial arm (1.1+2.1) and a section 1.2 and 2.2 respectively of the other axial arm (1.2+2.2) of the box profile.

A slide body 4 for suspending the fish mouth seal carrier on the guide vane arrangement is seated on both sides between radial flange 1.5 of the first half-shell element and radial flange 2.5 of the second half-shell element. To this end, the fish mouth seal carrier has a bolt 5 that penetrates through-holes in radial flanges 1.5, 2.5 and the slide body 4 arranged between these to thereby fix it. The slide body is accommodated in a through-hole in the form of an elongated hole 12 of the guide vane arrangement so that the fish mouth seal carrier is suspended by means of spoke centering on the guide vane arrangement. The slide body spaces apart the two radial flanges 1.5, 2.5 from each other and supports them against each other.

An additional plate 6 is fixed on radial flange 1.5 of the first half-shell element. It is axially supported on the guide vane arrangement and thereby axially secures the fish mouth seal carrier. The additional plate is arranged between radial flange 1.5 of the first half-shell element and radial flange 2.5 of the second half-shell element, particularly the slide body 4, and retained by bolt 5 in a friction-engaged manner to radial flange 1.5, particularly clamped between it and slide body 4.

The sealing element extends axially essentially from the one radial arm 1.3 to the other radial arm 2.3 of the box profile.

For producing the fish mouth seal carrier, both half-shell elements 1.1-1.5, 2.1-2.5 are cast in a casting-engineered manner or shaped in a forging-engineered manner. Both half-shell elements are designed as sheet metal constructions and have a wall thickness that is 5 mm maximum.

The two half-shell elements are subsequently welded to each other without filler materials, particularly through laser or friction welding. Both half-shell elements are contact-joined to each other by the front faces of one axial arm 1.1, 2.1 each of a U-profile of the half-shell elements.

After bonding, sealing element 3 is arranged on the axial arm (1.1+2.1) of the box profile and welded to it. In doing so, sealing element 3 covers an interface or butt joint 7 of the bonded joint connection of the two half-shell elements to each other and thereby secures the joint connection.

Figure 2:
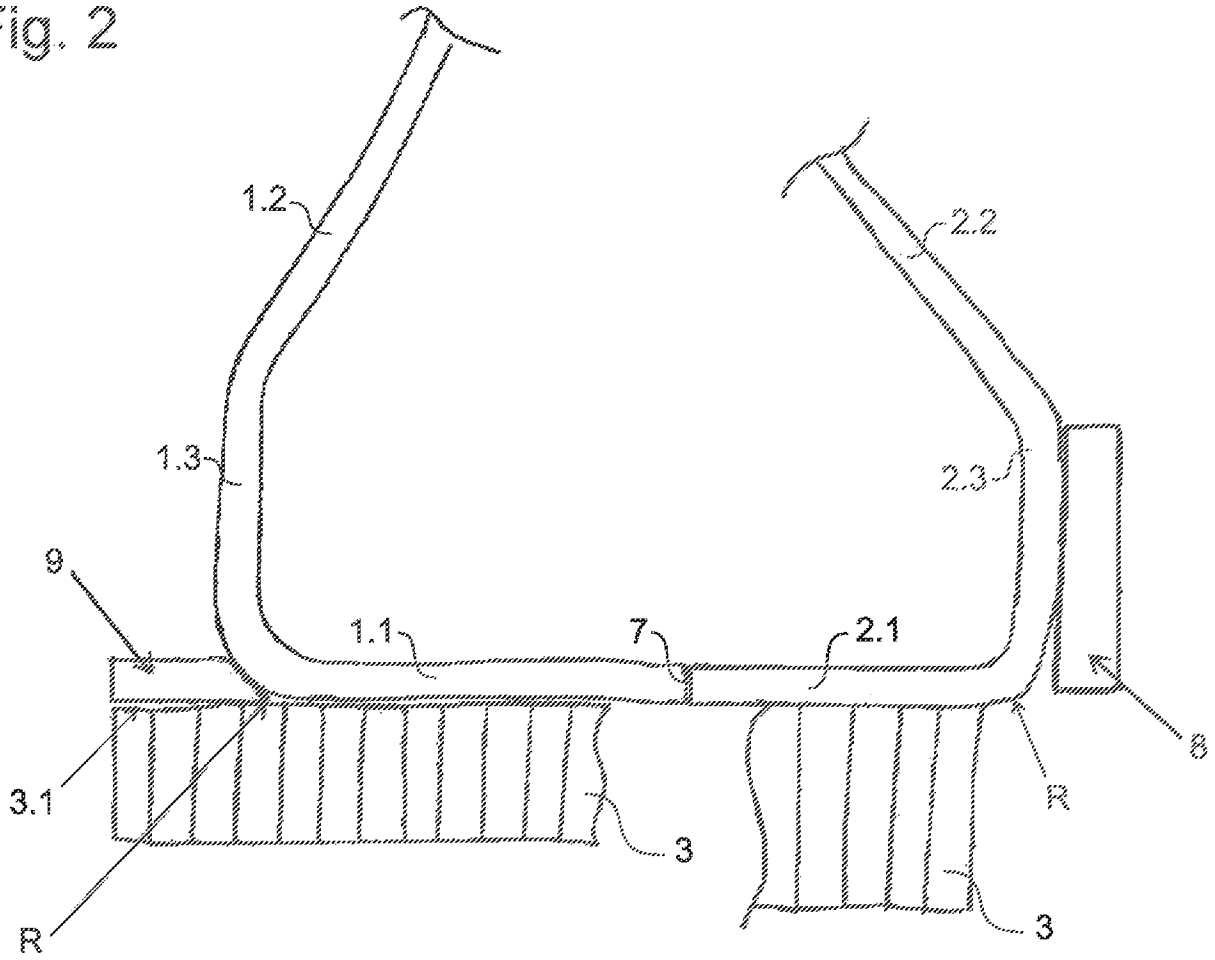
FIG. 2: a section of a fish mouth seal carrier of a guide vane arrangement of a gas turbine according to another embodiment of the present invention in a depiction corresponding to FIG. 1.

FIG. 2 depicts in an illustration corresponding to FIG. 1 a section of a fish mouth seal carrier of a guide vane arrangement of a gas turbine according to another embodiment of the present invention. Congruent elements are labeled with identical reference signs so that reference is made to the preceding description and subsequently only the differences to the design of FIG. 1 are addressed.

FIG. 2 depicts the lower section of the box profile with the radial inner axial arm 1.1+2.1 as well as the two radial arms 1.3 and 2.3. These transition into essentially right-angled corners that each has a radius R.

The (in FIG. 1, depicted non-continuously or incompletely) honeycomb seal 3 has an integrated carrier 3.1 with which it is arranged on the outside of axial arm 1.1+2.1 and is, or is to be, soldered to it.

The honeycomb seal extends axially from the one radial arm 1.3 to the other radial arm 2.3 of the box profile and projects axially over radial arm 1.3 in FIG. 2 to axially enlarge the sealing surface.

On the right radial arm 2.3 in FIG. 2, there is soldered on its side facing away from the box profile (right in FIG. 2) a reinforcing element in the form of a radial ring 8, whose wall thickness in a radial direction (vertical in FIG. 2) is at least double its wall thickness in the axial direction (horizontal in FIG. 2).

On the left radial arm 1.3 in FIG. 2, there is attached on its side facing away from the box profile (left in FIG. 2) a reinforcing element in the form of an axial ring 9, whose wall thickness is at least double its wall thickness in a radial direction and is soldered to honeycomb seal 3 axially projecting over radial arm 1.3.

Axial ring 9 has a half-shell element-facing (right in FIG. 2) contour that is essentially complementary to radius R between the seal-facing axial arm 1.1 and radial arm 1.3.

Reinforcing elements 8, 9 are first formed as ring-shaped. In particular, axial ring 9 is welded together from multiple ring segments and subsequently connected to half-shell element 1.3 by spot-welding. Then, honeycomb seal 3 is soldered to the half-shell elements and axial ring 9.

LIST OF REFERENCE SIGNS

1/2 First/second half-shell element

1.1/2.1 Axial arm of U-profile of first/second half-shell element

1.2/2.2 Axial arm of U-profile of first/second half-shell element
1.3/2.3 Radial arm of U-profile of first/second half-shell element
1.4/2.4 Axial flange of first/second half-shell element
1.5/2.5 Radial flange of first/second half-shell element
3 Honeycomb seal (sealing element)
3.1 Integrated carrier
4 Slide body
5 Bolt
6 Additional sheet
7 Interface or joint location (joint location)
8 Radial ring (reinforcing element)
9 Axial ring (reinforcing element)
10 Guide vane (arrangement)
11 Radial inner platform
12 Elongated hole
20/21 Blade (arrangement)
20.1/21.1 Axial flange of moving blade (arrangement) 20/21
R Radius

What is claimed is:

1. A fish mouth seal carrier for a guide vane arrangement of a gas turbine, the gas turbine having a guide vane with a radial inner platform defining a first axial extent and having a single spoke extending radially inward from the radial inner platform, a plurality of moving blades disposed axially adjacent to the guide vane, at least one of the moving blades having an axial flange disposed radially inward from the radial inner platform, the axial flange extending axially from the moving blade defining a second axial extent to a position radially across from the radial inner platform of the guide vane and within the first axial extent such that a first portion of the first axial extent of the radial inner platform axially overlaps at least some of the second axial extent of the axial flange of the moving blade on a radially outward side of the axial flange of the moving blade, the seal carrier comprising:

a first half-shell element having
a radial inner axial arm section,
a radial arm and
a radial outer axial arm section;

a second half-shell element having
a radial inner axial arm section,
a radial arm and
a radial outer axial arm section;

the first half-shell element connected to the second half-shell element so as to together form a box profile, the box profile including
a radial inner axial arm formed by connecting adjacent ends of the respective radial inner axial arm sections,
the two radial arms, the radial inner ends of the radial arms being connected, respectively, to non-adjacent ends of the respective radial inner axial arm sections, and
a radial outer axial arm formed by connecting non-adjacent ends of the respective radial outer axial arm sections, respectively, to radial outer ends of the two radial arms;

the box profile being mounted to the single spoke extending radially inward from the radial inner platform;

a sealing element mounted on the radial inner axial arm of the box profile; and at least one of the first and second half-shell elements including an integrally formed axial flange,
the integrally formed axial flange being configured to extend axially toward the at least one of the plurality of moving blades disposed axially adjacent to the guide vane having the axial flange extending axially therefrom,
the integrally formed axial flange being disposed radially inward from the axial flange of the moving blade,
the integrally formed axial flange defining a third axial extent and extending axially to a position radially across from the axial flange extending from the moving blade such that a second portion of the third axial extent of the integrally formed axial flange axially overlaps at least some of the second axial extent of the axial flange of the moving blade on a radially inward side of the axial flange of the moving blade,
which together with a radial inner platform of a guide vane of a gas turbine, forms a fish mouth seal accommodating the axial flange extending from the adjoining moving blade radially between the radial inner platform and the integrally formed axial flange such that the radial inner platform axially overlaps at least the first portion of the axial flange of the moving blade on the radial outward side and the integrally formed axial flange axially overlaps at least the second portion of the axial flange of the moving blade on the radial inward side.

2. A fish mouth seal carrier in accordance with claim 1, wherein at least one of the first half-shell element or the second half-shell element further includes:

a U-profile configured from the respective radial inner axial arm section, the respective radial arm and the respective radial outer axial arm section; and a radial flange connected at a first end to the respective radial outer axial arm section.

3. A fish mouth seal carrier in accordance with claim 2, wherein both the first and second half-shell elements include respective radial flanges disposed adjacent to the single spoke connected at a first end to the respective radial outer axial arm sections, and further comprising a slide body for suspending the fish mouth seal carrier on the single spoke of the guide vane, the slide body being seated in an elongated hole formed in the single spoke of the guide vane on both sides axially between the radial flange of the first half-shell element and the radial flange of the second half-shell element.

4. A fish mouth seal carrier in accordance with claim 1, wherein the sealing element includes a honeycomb seal.

5. A fish mouth seal carrier in accordance with claim 1, wherein the sealing element extends at least essentially axially at least from one radial arm to the other radial arm of the box profile.

6. A fish mouth seal carrier in accordance with claim 1, further comprising:

at least one reinforcing element connected to one radial flange of the box profile; and wherein the reinforcing element is one of a radial ring or an axial ring.

7. A fish mouth seal carrier in accordance with claim 6, wherein the reinforcing element is a radial ring having a first wall thickness in a radial direction that is at least double a second wall thickness in an axial direction.

8. A fish mouth seal carrier in accordance with claim 6, wherein the reinforcing element is an axial ring having a first wall thickness in an axial direction that is at least double a second wall thickness in a radial direction.

9. A fish mouth seal carrier in accordance with claim 1, wherein the axial flange of the first and/or second half-shell element extends at least essentially in an axial direction.

10. A fish mouth seal carrier in accordance with claim 9, wherein the axial flange further includes one of radial passages or stages.

11. A gas turbine comprising:

a guide vane including an radial inner platform defining a first axial extent and having a single spoke extending radially inward from the radial inner platform;

at least one moving blade axially adjoining the guide vane and including an axial flange disposed radially inward from the radial inner platform, the axial flange extending axially from the moving blade defining a second axial extent to a position radially across from the radial inner platform of the guide vane and within the first axial extent such that a first portion of the first axial extent of the radial inner platform axially overlaps at least some of the second axial extent of the axial flange of the moving blade on a radially outward side of the axial flange of the moving blade;

a seal carrier including a first half-shell element having a radial inner axial arm section, a radial arm and a radial outer axial arm section and a second half-shell element having a radial inner axial arm section, a radial arm and a radial outer axial arm section;

the first half-shell element connected to the second half-shell element so as to together form a box profile, the box profile including a radial inner axial arm formed by connecting adjacent ends of the respective radial inner axial arm sections, the two radial arms, the radial inner ends of the radial arms being connected, respectively, to non-adjacent ends of the respective radial inner axial arm sections, and a radial outer axial arm formed by connecting non-adjacent ends of the respective radial outer axial arm sections, respectively, to radial outer ends of the two radial arms;

the box profile being mounted to the single spoke extending radially inward from the radial inner platform;

a sealing element mounted on the radial inner axial arm of the box profile; and at least one of the first and second half-shell elements including an integrally formed axial flange the integrally formed axial flange extending axially toward the at least one moving blade disposed axially adjacent to the guide vane having the axial flange extending axially therefrom, the integrally formed axial flange being disposed radially inward from the axial flange of the moving blade, the integrally formed axial flange defining a third axial extent and extending axially to a position radially across from the axial flange extending from the moving blade such that a second portion of the third axial extent of the integrally formed axial flange axially overlaps at least some of the second axial extent of the axial flange of the moving blade on a radially inward side of the axial flange of the moving blade, which together with the radial inner platform of the guide vane, forms a fish mouth seal accommodating the axial flange extending from the adjoining moving blade radially between the radial inner platform and the integrally formed axial flange such that the radial inner platform axially overlaps at least the first portion of the axial flange of the moving blade on the radial outward side and the integrally formed axial flange axially overlaps at least the second portion of the axial flange of the moving blade on the radial inward side.

12. A method for producing a fish mouth seal carrier for a guide vane arrangement of a gas turbine, the gas turbine having a guide vane with a radial inner platform, a plurality of moving blades disposed axially adjacent to the guide vane, at least one of the moving blades having an axial flange extending therefrom to a position radially across from the radial inner platform of the guide vane, the method comprising the following steps:

providing a first half-shell element and a second half-shell element, each half-shell element including a radial inner axial arm section, a radial arm connected at one end to a first end of the radial inner axial arm section and connected at the other end to a radial outer axial arm section;

providing, on at least one of the half-shell elements, an integrally formed axial flange disposed radially outward from the half-shell element and extending axially toward the at least one of the moving blades to a position radially across from the axial flange extending from the at least one of the moving blades;

connecting the first half-shell element to the second half-shell element so as to form a box profile by bonding together a respective second end of the respective radial inner axial arm sections to form a radial inner axial arm; and connecting a sealing element to the radial inner axial arm of the box profile; and mounting the box profile to the radial inner platform such that such that the radial inner platform axially overlaps at least a first portion of the axial flange of the moving blade on the radial outward side and the at least one integrally formed axial flange axially overlaps at least a second portion of the axial flange of the moving blade on the radial inward side.

13. A method in accordance with claim 12, wherein the half-shell elements to be provided are produced by one of casting or forging.

14. A method in accordance with claim 12, wherein the two half-shell elements are butt-joined to one another on the front faces of their radial inner axial arm sections.

15. A method in accordance with claim 14, wherein the butt-joining is performed by welding.

16. A method in accordance with claim 12, wherein the sealing element is connected to the radial inner axial arm by soldering.

17. A method in accordance with claim 12, further comprising the step of connecting a reinforcing element to the sealing element, wherein the reinforcing element is one of an axial ring or a radial ring.

* * * * *